US011278755B1

(12) United States Patent
Wilkins

(10) Patent No.: US 11,278,755 B1
(45) Date of Patent: Mar. 22, 2022

(54) PHYSICAL THERAPY RESISTANCE AID

(71) Applicant: Derek Wilkins, Towanda, PA (US)

(72) Inventor: Derek Wilkins, Towanda, PA (US)

( * ) Notice: Subject to any disclaimer, the term of this patent is extended or adjusted under 35 U.S.C. 154(b) by 0 days.

(21) Appl. No.: 16/934,133

(22) Filed: Jul. 21, 2020

(51) Int. Cl.
*A63B 21/055* (2006.01)
*A63B 21/068* (2006.01)
*A63B 21/00* (2006.01)

(52) U.S. Cl.
CPC ..... *A63B 21/0557* (2013.01); *A63B 21/055* (2013.01); *A63B 21/0552* (2013.01); *A63B 21/068* (2013.01); *A63B 21/151* (2013.01); *A63B 2208/0204* (2013.01)

(58) Field of Classification Search
CPC ..... A63B 21/0557; A63B 21/055; A63B 21/0552; A63B 21/151; A63B 21/068; A63B 21/0407–0414; A63B 21/16; A63B 2208/0204; A63B 7/085; A63B 69/0035; A63B 69/345; A63B 69/206; A63B 69/20; A63B 69/203; A63B 69/12; A63B 23/047
See application file for complete search history.

(56) References Cited

U.S. PATENT DOCUMENTS 4,773,398 A 9/1988 Tatom
4,815,731 A 3/1989 Suarez
5,254,064 A * 10/1993 Rock ..... A63B 21/151 482/123
5,490,826 A 2/1996 Mallookis
5,549,532 A 8/1996 Kropp
5,836,857 A 11/1998 Jennings
6,716,119 B1 * 4/2004 Weisz ..... A63B 69/0084 473/423
7,494,450 B2 * 2/2009 Solomon ..... A61H 1/0229 482/51
7,651,448 B2 1/2010 Hetrick
8,434,824 B2 * 5/2013 Spinabella ..... A63B 21/4043 297/423.1
D726,841 S 4/2015 Wright
2002/0187884 A1 * 12/2002 McGrath ..... A63B 21/0552 482/121
2004/0185990 A1 * 9/2004 Orescan ..... A63B 23/0355 482/126
2004/0248703 A1 * 12/2004 Heger ..... A63B 21/0552 482/79
2008/0010787 A1 * 1/2008 Kinskey ..... A45F 5/02 24/298
2013/0303344 A1 * 11/2013 Rasnake ..... A63B 23/03508 482/124

(Continued)

*Primary Examiner* — Garrett K Atkinson
*Assistant Examiner* — Kathleen M Fisk

(57) ABSTRACT

The physical therapy resistance aid is a therapeutic device. The physical therapy resistance aid is adapted for use with a patient. The physical therapy resistance aid provides a counterforce used to strengthen the muscles of the patient. The physical therapy resistance aid includes an elastic cord, a handle, a plurality of rings, and a plurality of fasteners. The handle and the plurality of rings attach to the elastic cord. The plurality of rings attach the plurality of fasteners to the elastic cord. The plurality of fasteners attach the physical therapy resistance aid to a plurality of bollards. Each of the plurality of bollards forms anchor point to which a fastener selected from the plurality of fasteners attaches.

18 Claims, 4 Drawing Sheets

(56) References Cited

U.S. PATENT DOCUMENTS

| | | | | |
|---|---|---|---|---|
| 2014/0274587 | A1* | 9/2014 | Ruggiero | A63B 69/206<br>482/87 |
| 2014/0315666 | A1* | 10/2014 | Medley | A63B 21/00043<br>473/450 |
| 2019/0038928 | A1* | 2/2019 | Roberts | A63B 23/03516 |

* cited by examiner

PHYSICAL THERAPY RESISTANCE AID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports and apparatus for physical training, more specifically, an exercise apparatus for strengthening muscles by working against a counterforce.

SUMMARY OF INVENTION

The physical therapy resistance aid is a therapeutic device. The physical therapy resistance aid is adapted for use with a patient. The physical therapy resistance aid provides a counterforce used to strengthen the muscles of the patient. The physical therapy resistance aid comprises an elastic cord, a handle, a plurality of rings, and a plurality of fasteners. The handle and the plurality of rings attach to the elastic cord. The plurality of rings attach the plurality of fasteners to the elastic cord. The plurality of fasteners attach the physical therapy resistance aid to a plurality of bollards. Each of the plurality of bollards forms anchor point to which a fastener selected from the plurality of fasteners attaches.

These together with additional objects, features and advantages of the physical therapy resistance aid will be readily apparent to those of ordinary skill in the art upon reading the following detailed description of the presently preferred, but nonetheless illustrative, embodiments when taken in conjunction with the accompanying drawings.

In this respect, before explaining the current embodiments of the physical therapy resistance aid in detail, it is to be understood that the physical therapy resistance aid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the physical therapy resistance aid.

It is therefore important that the claims be regarded as including such equivalent construction insofar as they do not depart from the spirit and scope of the physical therapy resistance aid. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
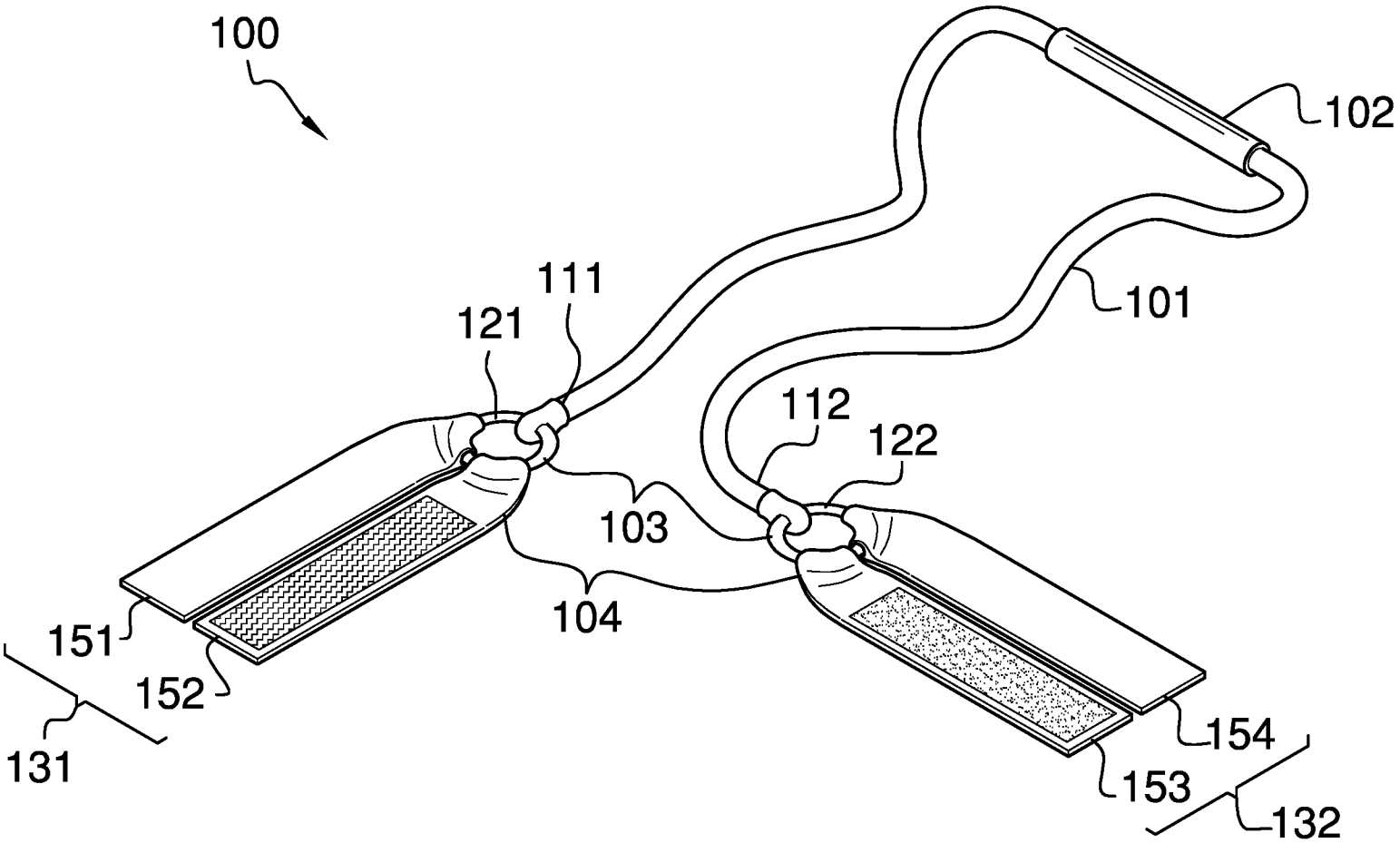
FIG. 1 is a perspective view of an embodiment of the disclosure.
Figure 2:
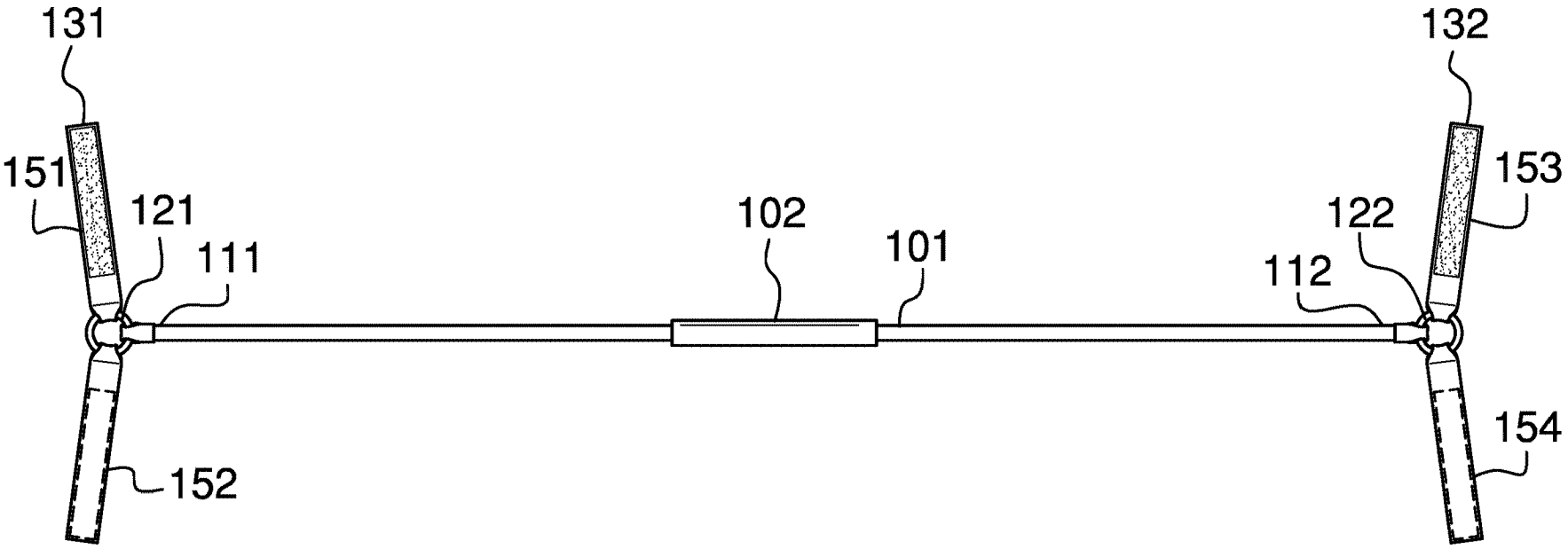
FIG. 2 is a front view of an embodiment of the disclosure.
Figure 3:
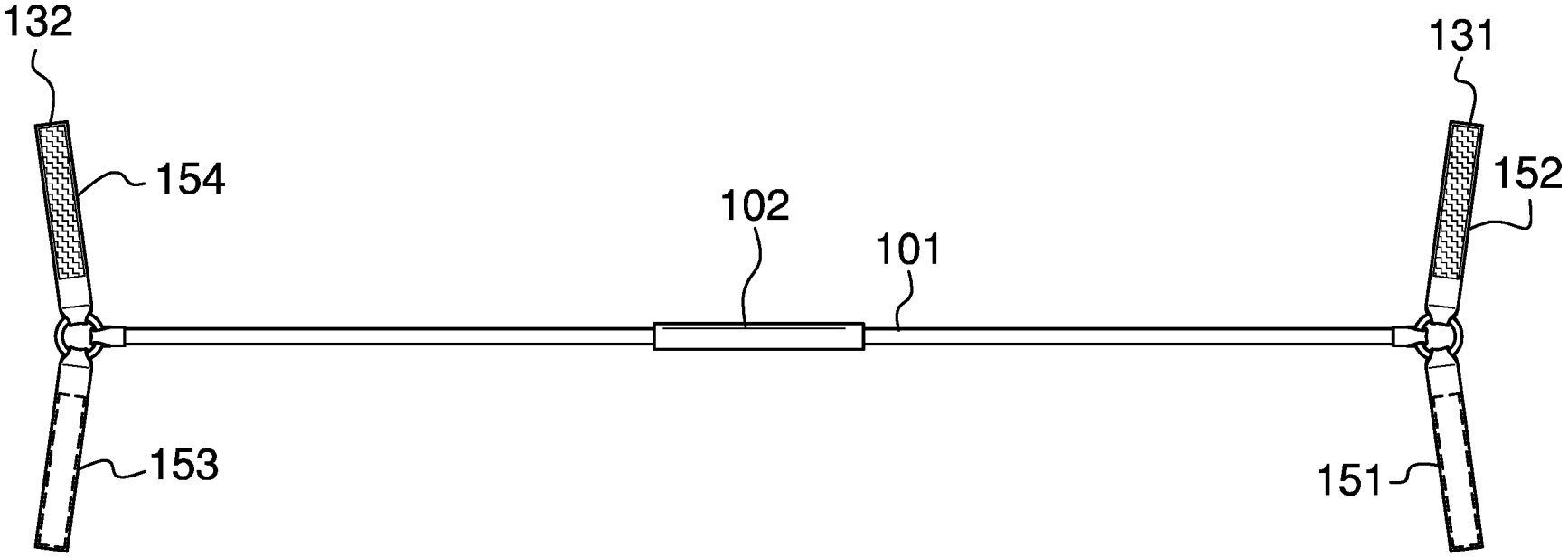
FIG. 3 is a rear view of an embodiment of the disclosure.
Figure 4:
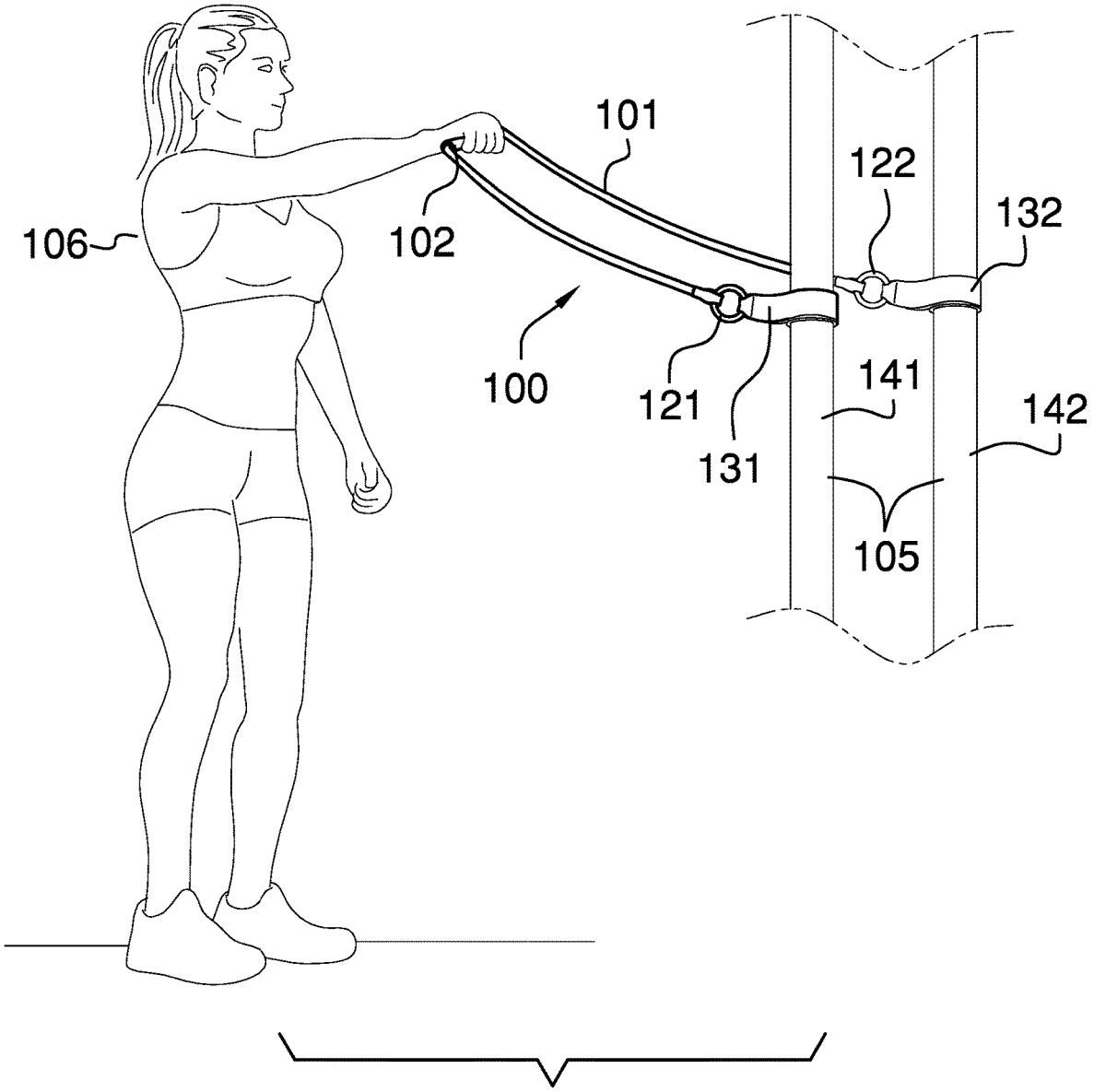
FIG. 4 is an in-use view of an embodiment of the disclosure.

Detailed reference will now be made to one or more potential embodiments of the disclosure, which are illustrated in FIGS. 1 through 4.

The physical therapy resistance aid 100 (hereinafter invention) is a therapeutic device. The invention 100 is adapted for use with a patient 106. The invention 100 provides a counterforce used to strengthen the muscles of the patient 106. The invention 100 comprises an elastic cord 101, a handle 102, a plurality of rings 103, and a plurality of fasteners 104. The handle 102 and the plurality of rings 103 attach to the elastic cord 101. The plurality of rings 103 attach the plurality of fasteners 104 to the elastic cord 101. The plurality of fasteners 104 attach the invention 100 to a plurality of bollards 105. Each of the plurality of bollards 105 forms anchor point to which a fastener selected from the plurality of fasteners 104 attaches.

The terms patient 106, elastic, cord, elastic cord 101, handle 102, grip, ring, fastener, hook and loop fastener, hook/loop surface, and bollard are formally defined elsewhere in this disclosure.

Each of the plurality of bollards 105 is a vertically oriented stanchion. The invention 100 anchors to the plurality of bollards 105. Each of the plurality of fasteners 104 attaches to a bollard selected from the plurality of bollards 105. The plurality of bollards 105 comprises a first bollard 141 and a second bollard 142.

The first bollard 141 is a stanchion that projects vertically away from a supporting surface. The first bollard forms an anchor point to which the invention 100 attaches. The first bollard 141 secures to the invention 100 such that the first bollard 141 forms a load path that allows the elastic cord 101 to horizontally elongate when the elastic cord 101 is pulled by the patient 106.

The second bollard 142 is a stanchion that projects vertically away from a supporting surface. The second bollard 142 forms an anchor point to which the invention 100 attaches. The second bollard 142 secures to the invention 100 such that the second bollard 142 forms a load path that allows the elastic cord 101 to horizontally elongate when the elastic cord 101 is pulled by the patient 106.

The elastic cord 101 provides the counterforce necessary to allow the patient 106 to properly exercise. The elastic cord is an elastomeric structure. The elastic cord 101 is a cord-like structure. The elastic cord 101 is a prism-shaped structure. The elastic cord 101 has a structure selected from the group consisting of a tubular prism structure and a solid prism structure. The elastic cord 101 is further defined with a first end 111 and a second end 112.

The elastic cord 101 acts as a spring. Specifically, when a force is applied to both ends of the elastic cord 101 in a direction parallel to the center axis of the elastic cord 101, the applied force elongates the span of the end to end length the elastic cord 101 in the direction parallel to the center axis of the elastic cord 101. The elasticity of the elastic cord 101 creates a force that opposes the displacement created by the applied force. The elasticity of the elastic cord 101 returns the elastic cord 101 to its relaxed shape. When the elongated elastic cord 101 is pulled by the patient 106, the force generated by the patient 106 will prevent the elastic cord 101 from returning to its relaxed shape.

The handle 102 is a grip that attaches to the elastic cord 101. The handle 102 has a tubular structure. The handle 102 is geometrically similar to the elastic cord 101. The inner dimension of the handle 102 is greater than the outer dimension of the elastic cord 101 such that the elastic cord 101 inserts through the hollow interior of the handle 102.

Each of the plurality of rings 103 is a ring structure. Each of the plurality of rings 103 are identical. Each of the plurality of rings 103 attaches to an end selected from the group consisting of the first end 111 of the elastic cord 101 and the second end 112 of the elastic cord 101. Each of the plurality of rings 103 attaches a fastener selected from the plurality of fasteners 104 to the elastic cord 101. The plurality of rings 103 comprises a first ring 121 and a second ring 122.

The first ring 121 is a ring-shaped structure selected from the plurality of rings 103. The first ring 121 attaches the first hook and loop fastener 131 selected from the plurality of fasteners 104 to the elastic cord 101.

The second ring 122 is a ring-shaped structure selected from the plurality of rings 103. The second ring 122 attaches the second hook and loop fastener 132 selected from the plurality of fasteners 104 to the elastic cord 101.

Each of the plurality of fasteners 104 is a fastening device. Each of the plurality of fasteners 104 are identical. Each of the plurality of fasteners 104 attaches to a ring selected from the plurality of rings 103. Each of the plurality of fasteners 104 attaches the invention 100 to a bollard selected from the plurality of bollards 105. In the first potential embodiment of the disclosure, the plurality of fasteners 104 comprises a first hook and loop fastener 131 and a second hook and loop fastener 132.

The first hook and loop fastener 131 is a fastener selected from the plurality of fasteners 104. The first hook and loop fastener 131 attaches the elastic cord 101 to a bollard selected from the plurality of bollards 105. The first hook and loop fastener 131 comprises a first hook/loop surface 151 and a second hook/loop surface 152.

The second hook and loop fastener 132 is a fastener selected from the plurality of fasteners 104. The second hook and loop fastener 132 attaches the elastic cord 101 to a bollard selected from the plurality of bollards 105. The second hook and loop fastener 132 comprises a third hook/loop surface 153 and a fourth hook/loop surface 154.

The first hook/loop surface 151 is a hook/loop surface associated with the first hook and loop fastener 131. The second hook/loop surface 152 is a hook/loop surface associated with the first hook and loop fastener 131. The third hook/loop surface 153 is a hook/loop surface associated with the second hook and loop fastener 132. The fourth hook/loop surface 154 is a hook/loop surface associated with the second hook and loop fastener 132.

The following four paragraphs describe the assembly of the invention 100.

The handle 102 slides over the elastic cord 101 to form a grip. The first ring 121 attaches to the first end 111 of the elastic cord 101. The second ring 122 attaches to the second end 112 of the elastic cord 101. The first ring 121 attaches the first hook and loop fastener 131 to the first end 111 of the elastic cord 101. The second ring 122 attaches the second hook and loop fastener 132 to the second end 112 of the elastic cord 101.

The first ring 121 directly attaches the first hook/loop surface 151 of the first hook and loop fastener 131 to the first end 111 of the elastic cord 101. By directly attached is meant that the attachment of the first hook/loop surface 151 of the first ring 121 is independent of the attachment of the second hook/loop surface 152 to the first ring 121. The first ring 121 directly attaches the second hook/loop surface 152 of the first hook and loop fastener 131 to the first end 111 of the elastic cord 101. By directly attached is meant that the attachment of the second hook/loop surface 152 of the first ring 121 is independent of the attachment of the first hook/loop surface 151 to the first ring 121.

The second ring 122 directly attaches the third hook/loop surface 153 of the second hook and loop fastener 132 to the second end 112 of the elastic cord 101. By directly attached is meant that the attachment of the third hook/loop surface 153 of the second ring 122 is independent of the attachment of the fourth hook/loop surface 154 to the second ring 122. The second ring 122 directly attaches the fourth hook/loop surface 154 of the second hook and loop fastener 132 to the second end 112 of the elastic cord 101. By directly attached is meant that the attachment of the fourth hook/loop surface 154 of the second ring 122 is independent of the attachment of the third hook/loop surface 153 to the second ring 122.

To attach the first end 111 of the elastic cord 101 to the first bollard 141, the first hook/loop surface 151 and the second hook/loop surface 152 of the first hook and loop fastener 131 loop around the first bollard 141 and are secured by pressing the second hook/loop surface 152 into the first hook/loop surface 151. To attach the second end 112 of the elastic cord 101 to the second bollard 142, the third hook/loop surface 153 and the fourth hook/loop surface 154 of the second hook and loop fastener 132 loop around the second bollard 142 and are secured by pressing the fourth hook/loop surface 154 into the third hook/loop surface 153.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Bollard: As used in this disclosure, a bollard is a stanchion used as an anchor point to anchor an object to a horizontal surface. Bollards are often called Samson posts.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Fastener: As used in this disclosure, a fastener is a device that is used to join or affix a first object to a second object.

Force of Gravity: As used in this disclosure, the force of gravity refers to a vector that indicates the direction of the pull of gravity on an object at or near the surface of the earth.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Dimension: As used in this disclosure, the term inner dimension describes the span from a first inside or interior surface of a container to a second inside or interior surface of a container. The term is used in much the same way that a plumber would refer to the inner diameter of a pipe.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Patient: As used in this disclosure, a patient is a person who is designated to receive a medical treatment, therapy or service. The term patient may be extended to an animal when used within the context of the animal receiving veterinary treatment or services.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Ring: As used in this disclosure, a ring is a term that is used to describe a disk-like structure through which an aperture is formed. Rings are often considered loops.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertically oriented prism-shaped pole, post, or support.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Therapeutic: As used in this disclosure, therapeutic is an adjective that refers to a medical, ameliorative, or hygienic substance, process, or procedure.

Tube: As used in this disclosure, the term tube is used to describe a rigid hollow prism-shaped device with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A therapeutic resistance device comprising an elastic cord, a handle, a plurality of rings, and a plurality of fasteners;

wherein the handle and the plurality of rings attach to the elastic cord;

wherein the plurality of rings attach the plurality of fasteners to the elastic cord;

wherein the therapeutic resistance device is adapted for use with a patient;

wherein the therapeutic resistance device is configured to provide a counterforce used to strengthen the muscles of the patient;

wherein the plurality of rings comprises a first ring and a second ring;

wherein the first ring is a ring-shaped structure selected from the plurality of rings;

wherein the second ring is a ring-shaped structure selected from the plurality of rings;

wherein the plurality of fasteners comprises a first hook and loop fastener and a second hook and loop fastener;

wherein the first hook and loop fastener comprises a first hook/loop surface and a second hook/loop surface;

wherein the first ring directly attaches the first hook/loop surface of the first hook and loop fastener to a first end of the elastic cord;

wherein by directly attached is meant that the attachment of the first hook/loop surface to the first ring is independent of the attachment of the second hook/loop surface to the first ring;

wherein the first ring directly attaches the second hook/loop surface of the first hook and loop fastener to the first end of the elastic cord;

wherein by directly attached is meant that the attachment of the second hook/loop surface of the first ring is independent of the attachment of the first hook/loop surface to the first ring.

2. The therapeutic resistance device according to claim 1 wherein the plurality of fasteners attach the therapeutic resistance device to a plurality of bollards;

wherein the therapeutic resistance device anchors to the plurality of bollards.

3. The therapeutic resistance device according to claim 2 wherein each of the plurality of bollards is a stanchion;

wherein each of the plurality of fasteners attaches to a bollard selected from the plurality of bollards.

4. The therapeutic resistance device according to claim 3 wherein the plurality of bollards comprises a first bollard and a second bollard;

wherein the first bollard is a stanchion that projects vertically away from a supporting surface;

wherein the first bollard forms an anchor point to which the therapeutic resistance device attaches;

wherein the first bollard secures to the therapeutic resistance device such that the first bollard forms a load path configured to allow the elastic cord to horizontally elongate when the elastic cord is pulled by the patient;

wherein the second bollard is a stanchion that projects vertically away from the supporting surface;

wherein the second bollard forms an anchor point to which the therapeutic resistance device attaches;

wherein the second bollard secures to the therapeutic resistance device such that the second bollard forms the load path configured to allow the elastic cord to horizontally elongate when the elastic cord is pulled by the patient.

5. The therapeutic resistance device according to claim 4 wherein the elastic cord is configured to provide the counterforce for the patient to exercise.

6. The therapeutic resistance device according to claim 5 wherein the elastic cord is an elastomeric structure;

wherein the elastic cord is a prism-shaped structure;

wherein the elastic cord has a structure selected from the group consisting of a tubular prism structure and a solid prism structure;

wherein the elastic cord is further defined with the first end and a second end.

7. The therapeutic resistance device according to claim 6 wherein the handle is a grip that attaches to the elastic cord;

wherein the handle has a tubular structure.

8. The therapeutic resistance device according to claim 7 wherein each of the plurality of rings attaches a fastener selected from the plurality of fasteners to the elastic cord.

9. The therapeutic resistance device according to claim 8 wherein the first hook and loop fastener attaches the elastic cord to the first bollard selected from the plurality of bollards;

wherein the second hook and loop fastener attaches the elastic cord to the second bollard selected from the plurality of bollards.

10. The therapeutic resistance device according to claim 9 wherein the handle is geometrically similar to the elastic cord.

11. The therapeutic resistance device according to claim 10 wherein an inner dimension of the handle is greater than an outer dimension of the elastic cord such that the elastic cord inserts through a hollow interior of the handle.

12. The therapeutic resistance device according to claim 11 wherein the first ring attaches the first hook and loop fastener selected from the plurality of fasteners to the elastic cord;

wherein the second ring attaches the second hook and loop fastener selected from the plurality of fasteners to the elastic cord.

13. The therapeutic resistance device according to claim 12 wherein the handle slides over the elastic cord to form the grip.

14. The therapeutic resistance device according to claim 13 wherein the first ring attaches to the first end of the elastic cord;

wherein the second ring attaches to the second end of the elastic cord;

wherein the first ring attaches the first hook and loop fastener to the first end of the elastic cord;

wherein the second ring attaches the second hook and loop fastener to the second end of the elastic cord.

15. The therapeutic resistance device according to claim 14 wherein the second hook and loop fastener comprises a third hook/loop surface and a fourth hook/loop surface;

wherein the second ring directly attaches the third hook/loop surface of the second hook and loop fastener to the second end of the elastic cord;

wherein by directly attached is meant that the attachment of the third hook/loop surface to the second ring is independent of the attachment of the fourth hook/loop surface to the second ring;

wherein the second ring directly attaches the fourth hook/loop surface of the second hook and loop fastener to the second end of the elastic cord;

wherein by directly attached is meant that the attachment of the fourth hook/loop surface to the second ring is independent of the attachment of the third hook/loop surface to the second ring.

16. The therapeutic resistance device according to claim 15 wherein to attach the first end of the elastic cord to the first bollard, the first hook/loop surface and the second hook/loop surface of the first hook and loop fastener are configured to loop around the first bollard and are secured by pressing the second hook/loop surface into the first hook/loop surface;

wherein to attach the second end of the elastic cord to the second bollard, the third hook/loop surface and the fourth hook/loop surface of the second hook and loop fastener are configured to loop around the second bollard and are secured by pressing the fourth hook/loop surface into the third hook/loop surface.

17. The therapeutic resistance device according to claim 7 wherein each of the plurality of rings is a ring structure;

wherein each of the plurality of rings are identical;

wherein each of the plurality of rings attaches to an end selected from the group consisting of the first end of the elastic cord and the second end of the elastic cord.

18. The therapeutic resistance device according to claim 17 wherein each of the plurality of fasteners is a fastening device;

wherein each of the plurality of fasteners are identical;

wherein each of the plurality of fasteners attaches the therapeutic resistance device to the respective bollard selected from the plurality of bollards.

* * * * *